US011583036B2

(12) United States Patent
Cook et al.

(10) Patent No.: US 11,583,036 B2
(45) Date of Patent: Feb. 21, 2023

(54) ARTICLE OF FOOTWEAR WITH CLOSURE SYSTEM

(71) Applicant: NIKE, Inc., Beaverton, OR (US)

(72) Inventors: Christopher S. Cook, Portland, OR (US); John Dimoff, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 135 days.

(21) Appl. No.: 17/130,221

(22) Filed: Dec. 22, 2020

(65) Prior Publication Data

US 2021/0196002 A1 Jul. 1, 2021

Related U.S. Application Data

(60) Provisional application No. 62/954,927, filed on Dec. 30, 2019.

(51) Int. Cl.
*A43C 11/14* (2006.01)
*A43B 1/00* (2006.01)

(52) U.S. Cl.
CPC ..... *A43C 11/1493* (2013.01); *A43B 1/0081* (2013.01)

(58) Field of Classification Search
CPC ..... A43C 11/1493
USPC ..... 36/50.1
See application file for complete search history.

(56) References Cited

U.S. PATENT DOCUMENTS 4,079,527 A * 3/1978 Antonious ..... A43C 11/1493 36/51
4,126,951 A 11/1978 Antonious
4,313,433 A 2/1982 Cramer
4,486,965 A * 12/1984 Friton ..... A43C 11/1493 D2/978
4,621,648 A 11/1986 Ivany
5,027,482 A 7/1991 Torppey
5,416,987 A 5/1995 Bemis et al.
5,465,506 A 11/1995 Matis et al.
D365,438 S 12/1995 Orzeck
5,819,439 A 10/1998 Sanchez
(Continued)

FOREIGN PATENT DOCUMENTS

CA 1237389 A 5/1988
DE 102011079085 1/2013
(Continued)

OTHER PUBLICATIONS

Mar. 22, 2021—(WO) ISR & WO—App. No. PCT/US20/066538.

*Primary Examiner* — Timothy K Trieu
(74) *Attorney, Agent, or Firm* — Banner & Witcoff, Ltd.

(57) ABSTRACT

Footwear that includes a closure system that enables a wearer to quickly and easily fasten the closure system is disclosed. The closure system may include a primary strap and a secondary strap arranged on opposite sides of the footwear where the secondary strap releasably attaches at one end to the primary strap and the primary strap releasably attaches at one end to the upper. The closure system allows for the secondary strap to be selectively attached to the primary strap prior to a wearer inserting a foot into the article of footwear such that the article of footwear is configured to be secured to the foot by simultaneously securing the primary strap and the secondary strap when releasable attachment region of the primary strap is attached to a releasable attachment region of located on the upper.

20 Claims, 3 Drawing Sheets

(56) References Cited

U.S. PATENT DOCUMENTS

| | | | | |
|---|---|---|---|---|
| 6,775,929 | B2 | 8/2004 | Katz et al. | |
| D513,361 | S | 1/2006 | Teriatnikov | |
| 7,380,354 | B2 | 6/2008 | Yamashita et al. | |
| 7,437,837 | B2 * | 10/2008 | Jacobs | A43C 11/008 36/50.1 |
| 7,487,603 | B2 | 2/2009 | Davis et al. | |
| 7,654,012 | B2 | 2/2010 | Kelley | |
| 8,522,455 | B2 * | 9/2013 | Rasmussen | A43C 11/1493 36/50.1 |
| D719,725 | S | 12/2014 | Katz et al. | |
| 8,898,936 | B1 * | 12/2014 | Thompson-Boothe | A43B 1/0081 36/138 |
| 9,320,318 | B2 | 4/2016 | Nurse et al. | |
| 9,532,625 | B2 | 1/2017 | Katz et al. | |
| 9,707,119 | B2 | 7/2017 | Berns et al. | |
| 9,713,359 | B2 | 7/2017 | Ko et al. | |
| 9,907,364 | B1 * | 3/2018 | Bosserman | A47G 25/80 |
| 2007/0033836 | A1 * | 2/2007 | Rasmussen | A43B 1/0081 36/50.1 |
| 2013/0340292 | A1 | 12/2013 | Cook et al. | |
| 2018/0242692 | A1 | 8/2018 | Houng et al. | |
| 2018/0289100 | A1 * | 10/2018 | Bell | A43B 11/00 |

FOREIGN PATENT DOCUMENTS

| | | | |
|---|---|---|---|
| EP | 0686360 | B1 | 12/1995 |
| FR | 2375841 | A1 | 7/1978 |
| FR | 3082399 | A1 | 12/2019 |

* cited by examiner

ARTICLE OF FOOTWEAR WITH CLOSURE SYSTEM

CROSS-REFERENCE TO RELATED APPLICATION

This application claims priority to U.S. Provisional Application No. 62/954,927, filed on Dec. 30, 2019. This application is incorporated by reference in its entirety.

FIELD OF THE INVENTION

The present technology relates to articles of footwear with a closure system that can be easily fastened.

BACKGROUND

Conventional articles of footwear are typically fastened with laces. The process of tying laces can sometimes be time consuming and can also be difficult for some individuals. A simpler fastening system compared to laces may be advantageous for individuals with disabilities as well as children. In addition, in some athletic events, a user may need to transition quickly from one type of footwear to another in a short amount of time, such as when transitioning from the cycling portion of a triathlon to the running portion. In these instances, an athlete may lose valuable time having to lace up and tie conventional footwear. Also, such laces are susceptible to becoming untied or loosened, especially during the course of athletic activities.

BRIEF DESCRIPTION OF THE DRAWINGS

The following Detailed Description will be better understood when considered in conjunction with the accompanying drawings in which like reference numerals refer to the same or similar elements in all of the various views in which that reference number appears. Also, the reader is advised that the attached drawings are not necessarily drawn to scale.

DETAILED DESCRIPTION

Figure 1:
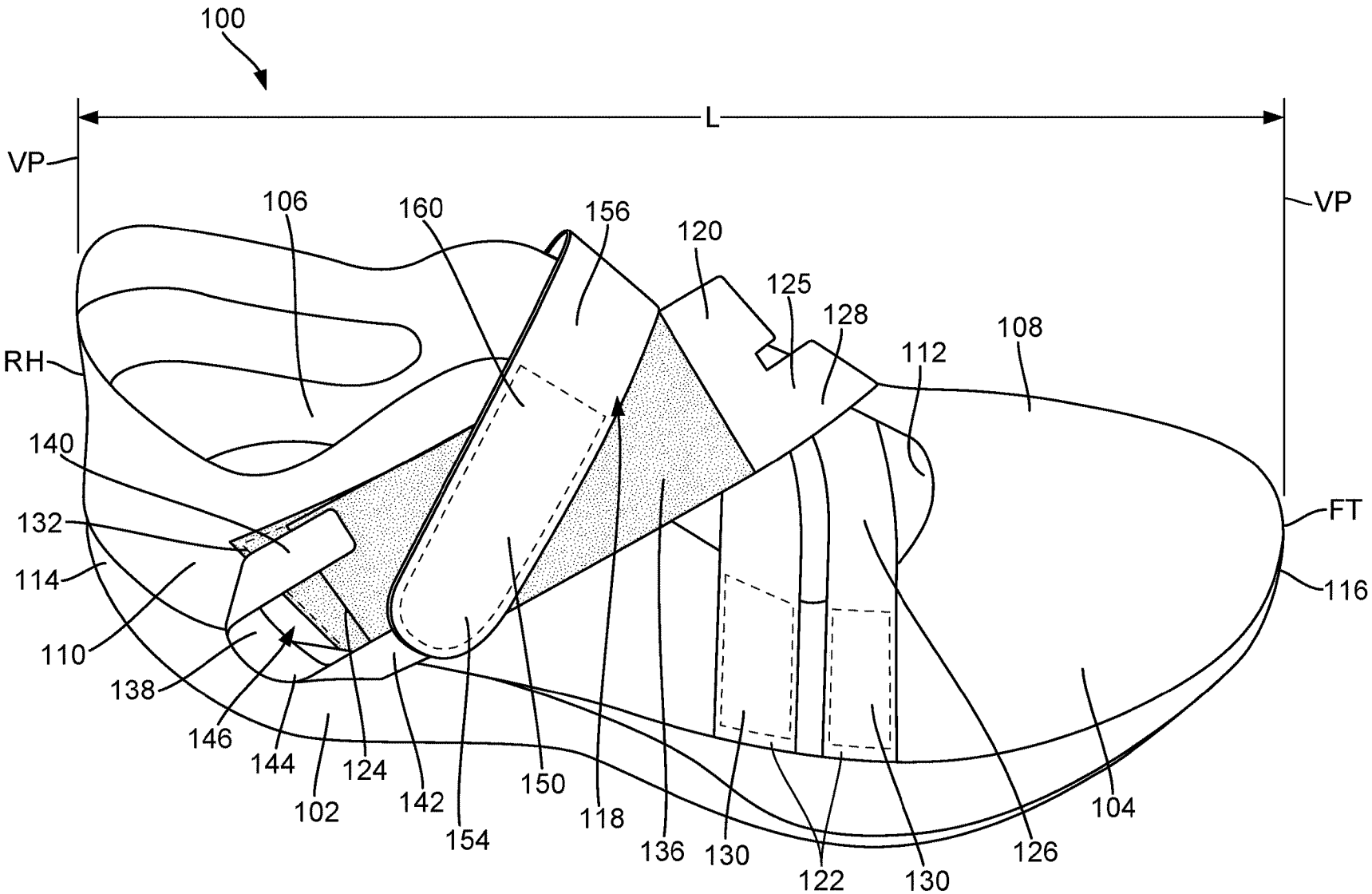
FIG. 1 illustrates a side perspective view of an article of footwear with the closure system in a closed position in accordance with aspects of this disclosure.

In the following description of various examples of footwear structures and closure systems according to the present disclosure, reference is made to the accompanying drawings, which form a part hereof, and in which are shown by way of illustration various example structures and environments in which aspects of the technology may be practiced. It is to be understood that other structures and environments may be utilized and that structural and functional modifications may be made to the specifically described structures, functions, and methods without departing from the scope of the present disclosure.

The following terms are used in this specification, and unless otherwise noted or clear from the context, these terms have the meanings provided below.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, dance shoes, etc.), and the like.

"Generally parallel," as the term is used herein, means that a first line, segment, plane, edge, surface, etc. is approximately (in this instance, within 5%) equidistant from with another line, plane, edge, surface, etc., over at least 50% of the length of the first line, segment, or edge, or over at least 50% of the area of the plane or surface, etc. In some examples, lines, segments, or edges may be considered "generally parallel" if one such a line, segment, or edge is approximately equidistant (±5%) to another respective line, segment, or edge over at least 60%, at least 75%, at least 85%, at least 90%, or even at least 95% of a length of either of the lines, segments, or edges being considered. Additionally, planes or surfaces may be considered "generally parallel" if one plane or surface is approximately equidistant (±5%) to another respective plane or surface over at least 60%, at least 75%, at least 85%, at least 90%, or even at least 95% of a surface area of either of the planes or surfaces being considered.

"Plurality," as the term is used herein, means any number greater than one, either disjunctively or conjunctively, as necessary, up to an infinite number.

"Fixed end," as the term is used herein, means an end portion of a strap where the end portion is joined to the sole structure and/or the upper with techniques such as stitching, adhesives, cements, or the like where separation of the joined pieces cannot be accomplished without structural damage to at least one of the joined pieces and/or the overall footwear structure.

"Free end," as the term is used herein, means an end portion of a strap where the end portion is free of a permanent connection to the sole structure and/or the upper. The "end portion" may be defined as the end length of the strap within a range of 0 percent to 20 percent of the overall length of that strap. In some examples, the "end portion" may include the endmost 101.6 mm (4 inches) of a strap.

"Proximate," as the term is used herein, means near or close to an object. For example, a first object may be defined as "proximate" to a second object, if a portion of the first object is located within 12.7 mm (0.5 inches) of at least some portion of the second object Various structures and parameters of articles of footwear and sole structures thereof are described based on a "sole length" parameter L. The sole length L can be found with the article of footwear and/or sole structure oriented on a horizontal support surface on its ground-facing surface in an unloaded condition (e.g., with no weight applied to it other than weight of other components of the article of footwear and/or sole structure). Once so oriented, parallel vertical planes VP that are perpendicular to the horizontal support surface are oriented to contact the rearmost heel (RH) location(s) and forwardmost toe (FT) location(s) of the article of footwear and/or sole structure. The parallel vertical planes VP should be oriented as far away from one another as possible while still in contact with the rearmost heel RH and forwardmost toe FT locations. The direct distance between these vertical planes VPs corresponds to the length (e.g., a longitudinal length) L of the article of footwear and/or sole structure. The locations of various footwear components are described in this specification based on their respective locations along the length L as measured forward from the rear heel vertical plane VP. The rearmost heel location(s) is (are) located at position 0L and the forwardmost toe location(s) is (are) located at position 1L along the length L. Intermediate locations along the length L are referred to by fractional locations (e.g., 0.25L) along the length L measured forward from the rear heel vertical plane VP. Note FIG. 1.

The terms "strap," "strap member," and "strap sub-member" as used herein, unless otherwise noted, mean a band of material having a substantially greater width dimension ("W") than a thickness dimension ("T"). In some example structures, "straps" or "strap portions" also may have a substantially greater length dimension ("L") than width dimension W. As some more specific examples, "straps," or "strap members," in accordance with at least some examples of this invention may have one or more of: (a) a width dimension to thickness dimension ratio ("WIT") over at least 75% of its length of at least 5, (b) an absolute width dimension W of at least 10 mm over at least 75% of its length L, (c) an absolute thickness dimension T of less than 3 mm over at least 75% of its length L, and/or (d) an absolute length dimension L of at least 2.5 times its widest width dimension over that length. A "strap," "strap member," or "strap sub-member" may be connected to or integrally formed with another element or component that is not a "strap," "strap member," or "strap sub-member."

As some more specific examples, "straps," or "strap members," in accordance with at least some examples of this invention may have one or more of:

a. a W/T ratio over at least 75% of the strap's length of at least 7.5, at least 10, at least 15, at least 20, or at least 25; in some examples, these W/T ratio ranges will be provided over at least 85%, at least 90%, at least 95%, or even over 100% of the strap's length;
b. a W/T ratio over at least 75% of strap's length in a range of 5 to 50, in a range of 7.5 to 48, or in a range of 10 to 45; in some examples, these W/T ratio ranges will be provided over at least 85%, at least 90%, at least 95%, or even over 100% of the strap's length;
c. an absolute thickness dimension T of less than 2.5 mm or less than 2 mm over at least 75% of the strap's length; in some examples, these thickness dimension T ranges will be provided over at least 85%, at least 90%, at least 95%, or even over 100% of the strap's length;
d. an absolute width dimension W over at least 75% of the strap's length of at least 8 mm, at least 10 mm, at least 15 mm, or at least 18 mm; in some examples, these width dimension ranges will be provided over at least 85%, at least 90%, at least 95%, or even over 100% of the strap's length;
e. an absolute width dimension W over at least 75% of the strap's length within a range from 8 to 75 mm, and in some examples, within a range from 10 to 65 mm or within a range from 12 to 60 mm; in some examples, these absolute strap width dimension W ranges will be provided over at least 85%, at least 90%, at least 95%, or even over 100% of the strap's length;
f. an absolute strap length L of at least 5 times or at least 7 times the strap's widest width dimension W over that length;

For determining the W/T ratios as described above, the width and thickness dimensions are measured at a common location on the strap structure. The strap's length dimension L may be measured as the dimension from: (a) a location where one end of the strap is fixed to the upper or sole structure (e.g., where the strap emerges from a location between the upper and the sole structure) and (b) a free end of the strap. The strap's thickness dimension T at a given point is measured as the direct distance (shortest distance) between a first major surface and a second major surface of the strap at that point. The strap's width dimension W at a given point is measured as the direct distance (shortest distance) from one side edge of the strap to its opposite side edge at that point. These measurements are made with the strap or strap portion held taut but not under a substantial tensile force (e.g., less than 0.5 kg tensile force).

While "straps," "strap members," or "strap sub-members" may be stretchable or unstretchable, in the illustrated examples, the straps, strap members, and strap sub-members are stretchable. The terms "not stretchable" or "unstretchable," as used herein in this context, mean that the "strap," "strap member," or "strap sub-member" stretches less than 5% of its unloaded longitudinal length under a tensile force of 10 kg.

I. GENERAL DESCRIPTION OF ASPECTS OF THIS DISCLOSURE

As noted above, articles of footwear and closure systems in accordance with aspects of this technology may be well suited for footwear used in athletic endeavors where a wearer may need to change footwear quickly. In other examples, these closure systems also may be well suited for footwear used by children or others who may have difficulties with traditional closure systems like laces. Such closure systems may be well suited for any footwear.

At least some aspects of this disclosure relate to articles of footwear including a sole structure; an upper connected to the sole structure, where the upper includes a first side, a second side opposite the first side, and an instep opening located between and partially separating the first side from the second side; and a closure system. The closure system may include a primary strap having a first fixed end, a first free end, and a primary strap member extending between the first fixed end and the first free end, where the first fixed end is attached to at least one of the sole structure or the upper at the first side of the upper. The primary strap member may extend continuously: (a) from the first fixed end, (b) across the instep opening, (c) through a first aperture defined through the second side of the upper proximate to the instep opening, and (d) across the instep opening, and the first free end of the primary strap may be releasably attached to the first side of the upper rearward of a location where the first fixed end is attached to at least one of the sole structure or the upper. The closure system may also include a secondary strap that has a second fixed end, a second free end, and a secondary strap member extending between the second fixed end and the second free end, where the second fixed end is attached to at least one of the sole structure or the upper at the second side of the upper and rearward of the first aperture, and wherein the second free end of the secondary strap is releasably attached to the primary strap closer to the first free end than to the first fixed end.

Additional aspects of this disclosure relate to articles of footwear with a closure system where the primary strap includes a first side and a second side opposite the first side, where the first side of the primary strap has a first releasable attachment region and the second side of the primary strap has a second releasable attachment region. The first free end of the primary strap releasably attached to the first side of the upper may utilize the first releasable attachment region to engage an upper releasable attachment region extending along the first side of the upper. The secondary strap of the closure system may have a third releasable attachment region, where the second free end of the secondary strap is releasably attached to the primary strap by the third releasable attachment region engaging the second releasable attachment region of the primary strap. The second free end of the secondary strap can releasably fix to the primary strap in multiple locations along the length of the second releasable attachment region of the primary strap. The primary strap member may include a portion having a plurality of primary strap sub-members, where each of the primary strap sub-members attaches to at least one of the sole structure or the upper at the first side of the upper to form the first fixed end of the primary strap. In some examples, a second aperture may be defined on the second side of the upper proximate to the first aperture, where the first aperture receives one of the plurality of primary strap sub-members and the second aperture receives another of the plurality of primary strap sub-members. The closure system may also include a grip member, e.g., such as a grip member that includes two fixed ends attached to the primary strap proximate the first free end and an elongated member extending between the two fixed ends forming an opening between the elongated member and the primary strap. In some examples, the first side of the footwear may be a medial side of the article of footwear, and the second side may be a lateral side of the article of footwear. In other examples, however, the first side may be a lateral side of the article of footwear and the second side may be a medial side of the article of footwear.

Still other aspects of this disclosure relate to articles of footwear including a sole structure; an upper connected to the sole structure, where the upper includes a first side and a second side opposite the first side; and a closure system. The closure system may include a primary strap having a first end, a second end, and a primary strap member extending between the first end and the second end. The primary strap member may include a first portion that includes a first releasable attachment region and a second releasable attachment region arranged on opposite surfaces of the primary strap member. The first portion of the primary strap member may be located closer to the first end than to the second end. The primary strap member may further include a second portion, where the second portion includes a plurality of primary strap sub-members, where the plurality of primary strap sub-members extend to the second end and are fixed to a lateral side of the article of footwear. The first releasable attachment region may be releasably secured to an upper attachment region on the lateral side of the article of footwear. The closure system may also have a secondary strap that includes a fixed end on a medial side of the article of footwear, a free end, and a secondary strap member extending between the fixed end and the free end. The secondary strap member may have a third releasable attachment region, where the third releasable attachment region releasably attaches to the second releasable attachment region of the primary strap. The third releasable attachment region releasably may engage the second releasable attachment region of the primary strap member such that the secondary strap can releasably attach to the primary strap in multiple locations along a length of the second releasable attachment region, e.g., to allow user control of fit and tightness for the secondary strap. The second releasable attachment region and the third releasable attachment region may form a hook and loop type fastener. In some examples, the plurality of primary strap sub-members may extend through a plurality of apertures on the medial side of the article of footwear such that each aperture of the plurality of apertures receives one of the plurality of primary strap sub-members. The plurality of primary strap sub-members may include a first strap sub-member and a second strap sub-member, where the first strap sub-member and the second strap sub-member are generally parallel to each other. In addition, a width of each primary strap sub-member may be less than a width of the first portion of the primary strap member. The secondary strap may be selectively fitted to and/or attached to the primary strap prior to a wearer inserting a foot into the article of footwear such that the article of footwear is configured to be secured to the foot by simultaneously securing the primary strap and the secondary strap when the first releasable attachment region of the primary strap is attached to the upper attachment region.

Yet other aspects of this disclosure may relate to articles of footwear including a sole structure; an upper connected to the sole structure, wherein the upper includes an instep opening and a first releasable attachment region located on a lateral side of the upper; and a closure system. The closure system has a primary strap that further includes a first portion having: (a) a second releasable attachment region proximate a free end of the primary strap, and (b) a third releasable attachment region arranged on an opposite side of the primary strap from the second releasable attachment region proximate the free end of the primary strap. The primary strap also has a second portion that includes a plurality of primary strap sub-members, where each primary strap sub-member of the plurality of primary strap sub-members has a fixed end attached on the lateral side of the upper proximate the instep opening, and a second end attaching to the first portion of the primary strap, and where each primary strap sub-member extends: (a) from its fixed end, (b) across a centerline of the upper, and (c) through an aperture on a medial side of the upper proximate the instep opening. The closure system may further include a grip member provided at the free end of the primary strap, where the grip member includes an opening defined between the grip member and the free end of the primary strap. The secondary strap may have a fixed end on the medial side of the article of footwear, a fourth releasable attachment region, and a free end, where the second releasable attachment region releasably engages first releasable attachment region in multiple locations along a length of the first releasable attachment region, and where the fourth releasable attachment region releasable engages the third releasable attachment region in multiple locations along a length of the third releasable attachment region. Additionally, the secondary strap may be selectively attached to the primary strap prior to a wearer inserting a foot into the article of footwear such that the article of footwear is configured to be secured to the foot in a single strap attaching action by simultaneously securing the primary strap and the secondary strap when the second releasable attachment region of the primary strap is attached to the first releasable attachment region of the upper.

Given the general description of features, examples, aspects, structures, processes, and arrangements according to certain examples of the technology provided above, a more detailed description of specific example sole structures, articles of footwear, and/or methods in accordance with this disclosure follows.

II. DETAILED DESCRIPTION OF EXAMPLE ARTICLES OF FOOTWEAR, SOLE STRUCTURE, AND OTHER COMPONENTS/FEATURES ACCORDING TO ASPECTS OF THIS DISCLOSURE

Referring to the figures and following discussion, various examples of articles of footwear and closure systems in accordance with aspects of this technology are described.

Figure 2:
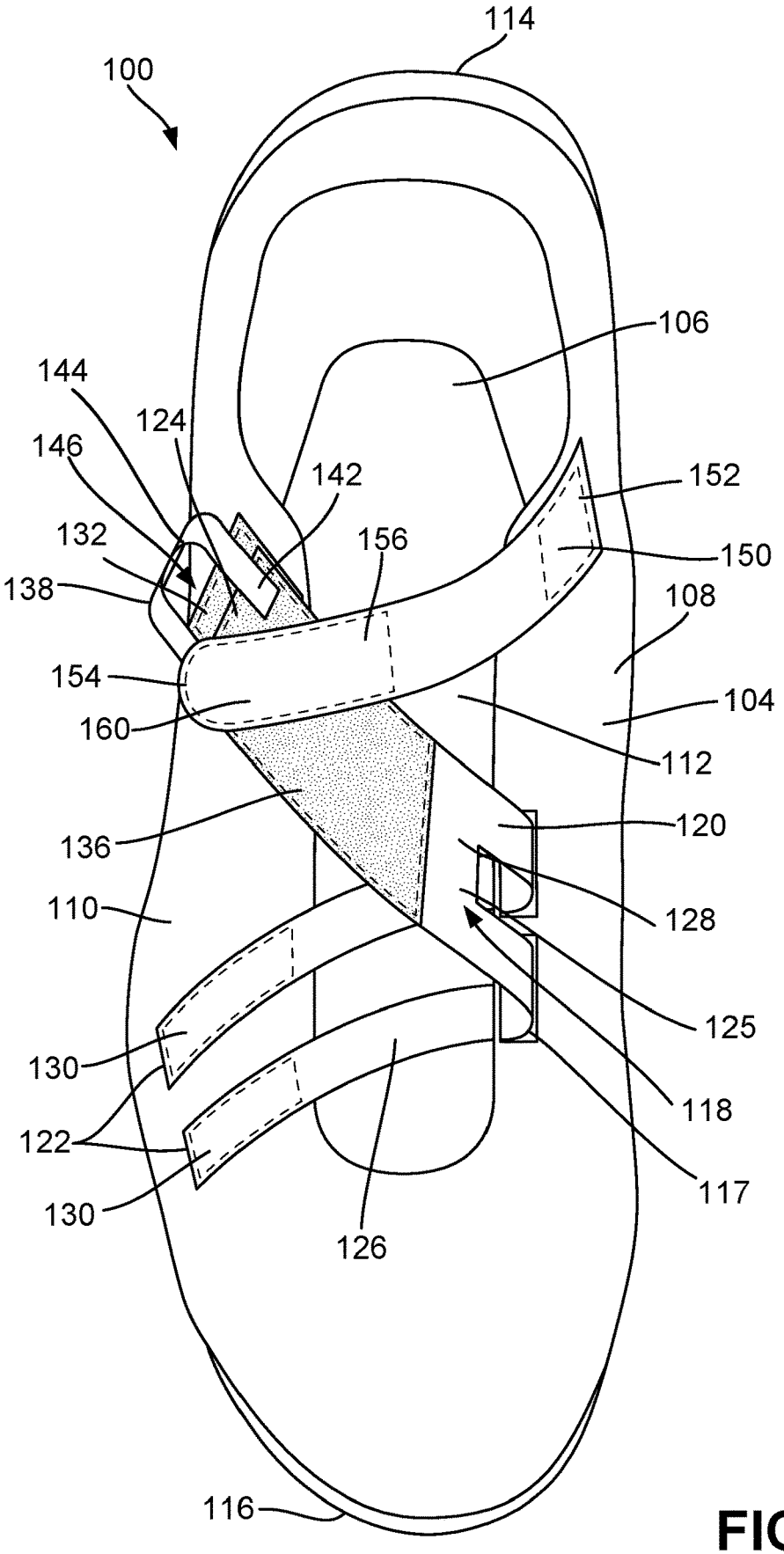
FIG. 2 illustrates a top view of an article of footwear with the closure system in a closed position in accordance with aspects of this disclosure.
Figure 3:
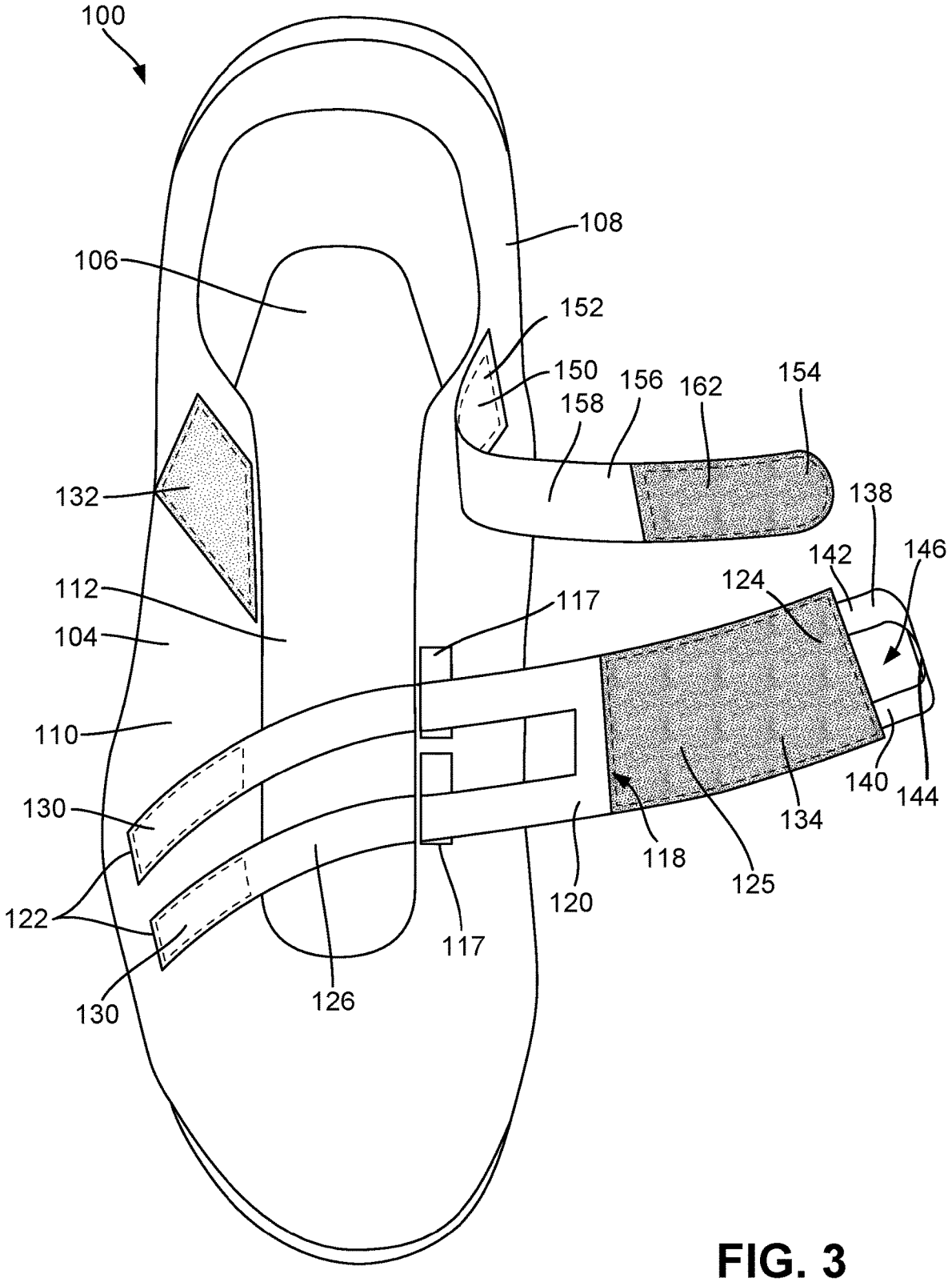
FIG. 3 illustrates a top view of an article of footwear with the closure system in an open position in accordance with aspects of this disclosure.

FIGS. 1-3 illustrate an article of footwear 100 that includes a sole structure 102 with an upper 104 connected to the sole structure 102. The upper 104 and sole structure 102 may be engaged together in any desired manner, including in manners conventionally known and used in the footwear arts (such as by one or more of adhesives or cements, stitching or sewing, mechanical connectors, etc.).

The sole structure 102 may be generally positioned between a foot of a wearer and the ground. The sole structure 102 may be made from any desired material(s) and/or in any desired constructions and/or manners without departing from this technology. In some examples, sole structure 102 may include one or more of an outsole, a midsole, a single piece sole, and/or any number of additional components associated with a conventional sole. The components for sole structure 102 may have structures and/or constructions like those used in footwear products commercially available from NIKE, Inc. of Beaverton, Oreg. and/or other manufacturers, including conventional structures and constructions as are known and used in the art.

The upper 104 (which may be formed from one or more parts), potentially together with the sole structure 102, defines a foot-receiving interior chamber 106 for containing a wearer's foot. The bottom of the upper 104 may include a strobel or other component engaged with or integrally formed with another portion of the upper 104. The upper 104 may include other components as well. For example, the upper 104 may include a tongue member located across the foot instep area and positioned to moderate the feel of the footwear's closure system on the wearer's foot; a closure system as described in more detail below; a heel counter; a toe cap; etc. Additionally or alternatively, the upper 104 may include a "sock-like" upper component, e.g., made from fabric and configured to closely fit the wearer's foot like a conventional sock.

The upper 104 may be made from any desired material(s) and/or in any desired constructions and/or manners without departing from this technology. As some more specific examples, all or at least a portion of the upper 104 (and optionally a majority, substantially all, or even all of the upper 104) may be formed as a woven textile component, a knitted textile component, another textile component, a natural leather component, a synthetic leather component, a polymeric component (e.g., a TPU, etc.), etc. The components for upper 104 may have structures and/or constructions like those used in footwear products commercially available from NIKE, Inc. of Beaverton, Oreg. and/or other manufacturers, including conventional structures and constructions as are known and used in the art.

Additionally or alternatively, if desired, uppers 104 and articles of footwear 100 in accordance with at least some examples of this technology may include fused layers of upper materials, e.g., uppers of the types that include upper materials bonded by hot melt or other adhesive materials, such as in footwear products commercially available from NIKE, Inc. of Beaverton, Oreg. As still additional examples, uppers of the types described in U.S. Pat. Nos. 7,347,011 and/or 8,429,835 may be used without departing from this technology (each of U.S. Pat. Nos. 7,347,011 and 8,429,835 is entirely incorporated herein by reference).

The article of footwear 100 may also include a medial side 108 and a lateral side 110 arranged opposite the medial side 108, and an instep opening 112 may be located between and partially separating the medial side 108 from the lateral side 110. The article of footwear may further have a heel region 114 near a wearer's heel and a forefoot region 116 near a wearer's toes. The article of footwear 100 may further include a closure system 118 having a primary strap 120 and a secondary strap 150. The secondary strap 150 may be fixedly attached to an opposite side of the footwear 100 than the fixed attachment of the primary strap 120 and may be releasably attached to the primary strap 120 to enable the user to fasten the closure system 118 by attaching the primary strap 120 to one of the upper 104 or sole structure 102. As such, the closure system 118 may have a closed or fastened position when the primary strap 120 is attached at its free end 124 to the footwear 100 as shown in FIGS. 1 and 2 and an open or unfastened position when the primary strap 120 is unattached at its free end 124 to the footwear 100 and the secondary strap 150 is unattached to the primary strap 120 as shown in FIG. 3. Optionally, the secondary strap 150 may remain engaged with the primary strap 120 while the closure system 118 is in the open or unfastened position.

The primary strap 120 may have a fixed end 122, a free end 124, and a primary strap member 125 extending between the fixed end 122 and the free end 124. The fixed end 122 may be attached to at least one of the sole structure 102 or the upper 104 at the lateral side 110 of the footwear 100. The fixed end 122 may be closer to the forward toe FT location than the rearmost heel RH location. For instance, the fixed end 122 may be located along the footwear 100 at a location forward of 0.5L, or forward of 0.6L, or even forward of 0.7 L. The primary strap 120 may also include a first surface 126 and a second surface 128 opposite the first surface 126. The first surface 126 of the primary strap 120 may include a first releasable attachment region 134, while the second surface 128 of the primary strap 120 may have a second releasable attachment region 136. In addition, the primary strap 120 may have a first portion closer to the free end 124 that includes both of the releasable attachment regions 134, 136 and a second portion closer to the fixed end 122 that may include a plurality of primary strap sub-members 130.

As shown in FIGS. 1 and 2, the primary strap 120 may extend continuously from the fixed end 122 across the instep opening 112 and through an aperture 117 that extends through the upper 104 proximate to the instep opening 112 on an opposite side of the footwear 100 from the fixed end 122. In some examples, the aperture 117 may form an elongated shape, and the aperture 117 may be located rearward of the fixed end 122 of the primary strap 120. For instance, in some examples, the aperture 117 may be located along the upper 104 at a location within a range of 0.5L and 0.7L. The primary strap 120 may then extend from the aperture 117 across the instep opening 112 toward an opposite side of the footwear 100. The first releasable attachment region 134 near the free end 124 of the primary strap 120 may be releasably attached to an upper releasable attachment region 132 located on the same side of the upper 104 as the fixed end 122. The upper releasable attachment region 132 may be located rearward (toward the heel region 114) of the location of the fixed end 122 of the primary strap 120. In some structures, the upper releasable attachment region 132 may be located proximate the opening to the foot-receiving interior chamber 106 and the extend around a portion of the opening, while in other structures, the upper releasable attachment region 132 may extend away from the instep opening 112 forming an acute angle with the sole structure 102.

The closure system 118 may further include a secondary strap 150 having a fixed end 152, a free end 154, and a secondary strap member 156 extending between the fixed end 152 and the free end 154. The fixed end 152 may be attached to at least one of the sole structure 102 or the upper 104 at the medial side 108 of the upper 104. The fixed end 152 of the secondary strap 150 may be located rearward of the aperture 117. For instance, in some examples, the fixed end 152 may be located along the footwear 100 within a range of 0.15L and 0.45L. In some examples, the fixed end 152 of the secondary strap 150 may be located proximate the opening to the foot-receiving interior chamber 106 and the extend around a portion of the opening, while in other examples, the fixed end 152 may extend away from the instep opening 112 forming an acute angle with the sole structure 102.

The secondary strap 150 may also include a first surface 158 and a second surface 160 opposite the first surface 158. The first surface 158 may include a releasable attachment region 162, where the releasable attachment region 162 on the free end 154 of the secondary strap 150 may releasably attach to the second releasable attachment region 136 of the primary strap 120 in multiple locations along the length of the second releasable attachment region 136. In this manner, a user can adjust the fit of the footwear 100 by moving the locations of the attachment of the secondary strap 150 to the primary strap 120. In some instances, the secondary strap 150 may be selectively attached to the primary strap 120 prior to a wearer inserting a foot into the article of footwear 100 such that the article of footwear 100 may be configured to be secured to the foot by simultaneously securing the primary strap 120 and the secondary strap 150 when the first releasable attachment region 134 of the primary strap is attached to the upper releasable attachment region 132.

In another optional example, the fixed ends 122, 152 of the respective straps 120, 150 may be attached on opposite sides of the footwear 100. The footwear 100 may include apertures 117 arranged on both sides of the footwear 100 such that the primary strap 120 may extend across the instep opening 112 multiple times, if desired. For example, the primary strap 120 may extend across the instep opening 112 an even number of times (i.e. 4, 6, etc. times) such that the free end 124 releasably attaches to the upper releasable attachment region 132 on the same side as the fixed end 122.

Alternatively, if desired, the closure system 118 may be arranged as described above except that the closure system 118 may be arranged where the primary strap 120 and the secondary strap 150 have their respective fixed ends 122, 152 arranged on opposite sides of the footwear 100 than the example described above. For instance, the fixed end 122 of the primary strap 120 may be attached to at least one of the sole structure 102 or the upper 104 at the medial side 108 of the footwear 100 and the fixed end 152 of the secondary strap 150 may be attached to at least one of the sole structure 102 or the upper 104 on the lateral side 110 of the footwear 100.

As another option, if desired, the closure system 118 may be arranged as described above except that the closure system 118 may be arranged where the primary strap 120 and the secondary strap 150 have their respective fixed ends 122, 152 located on the same side of the footwear 100. For example, the fixed end 122 of the primary strap 120 may be attached to at least one of the sole structure 102 or the upper 104 at the medial side 108 or lateral side 110 of the footwear 100 and fixed end 152 of the secondary strap 150 may be attached at least one of the sole structure 102 or the upper 104 on the same side of the footwear 100 as fixed end 122. In this example structure, the primary strap 120 may traverse across the instep opening 112 a plurality of times where the primary strap 120 extends through apertures 117 arranged on both sides of the instep opening 112. For instance, the primary strap 120 may extend across the instep opening 112 an odd number of times (i.e. 3, 5, etc. times) such that the free end 124 releasably attaches to the upper releasable attachment region 132 on an opposite side of the footwear 100 as the fixed end 122. In this example, the fixed end 152 of the secondary strap 150 may extend from the same side of the footwear 100 across a portion of the instep opening 112 and releasably attach to the primary strap 120.

As still another alternative, if desired, the closure system 118 may be arranged as described above except that the closure system 118 may be arranged where the primary strap 120 and the secondary strap 150 have their respective fixed ends 122, 152 located on the same side of the footwear 100 and the primary strap 120 extends across the instep opening 112 only once and then attach to the upper releasable attachment region 132 located on an opposite side of the footwear 100 as the fixed end 122. The fixed end 152 of the secondary strap 150 may extend from the same side of the footwear 100 across a portion of the instep opening 112 and releasably attach to the primary strap 120. Further, in this example, the primary strap 120 may or may not extend through aperture 117.

As discussed above, in some examples, the primary strap 120 may have a second portion that may include a plurality of primary strap sub-members 130, where each of the primary strap sub-members 130 may attach to at least one of the sole structure 102 or the upper 104 at the lateral side 110 of the upper 104 to form the fixed end 122 of the primary strap 120. In some example structures, each primary strap sub-member may be generally parallel to each other, while in other example structures, the primary strap sub-members 130 may diverge away from each other or converge toward each other. This convergence or divergence may begin from either at the fixed end 122 or at the location where the sub-members 130 connect to the first portion of the primary strap 120. These strap sub-members 130 may help to provide individualized and localized tension elements to provide an optimal fit around the foot of a wearer. Each primary strap sub-member 130 may have a width that is less than a width of the first portion of the primary strap member. In other examples, the plurality of primary strap sub-members 130 may comprise at least 3 sub-members 130, at least 4 sub-members, or more than 4 sub-members 130. In addition, the aperture 117 may comprise a plurality of apertures 117 to receive the plurality of the strap sub-members 130. For example, as shown in the exemplary structures of FIGS. 1-3, the aperture 117 may comprise a first and second aperture defined on the medial side 108 of the upper 104 proximate each other, where each aperture receives one of the plurality of primary strap sub-members 130. Alternatively, an aperture 117 may receive more than one of the plurality of primary strap sub-members 130.

As another potential feature, the closure system 118 may include a grip member 138. This grip member 138 may have a variety of different constructions. As one example, the grip member 138 may include two fixed ends 140, 142 attached to the primary strap 120 proximate the free end 124 and an elongated member 144 extending between the two fixed ends 140, 142 forming an opening 146 between the elongated member 144 and the primary strap 120. In some examples, the grip member 138 may be an opening within the primary strap 120 near the free end 124, where the opening as a width sufficient to receive a finger or thumb of a wearer to provide a surface for a wearer to easily grasp and quickly attach the primary strap 120 to the upper releasable attachment region 132. As another option, the grip members 138 may be a tab attached to the free end 124 of the primary strap 120 that allow a wearer to easily grasp the tab and quickly attach the primary strap 120 to the upper releasable attachment region 132.

The straps 120, 150 may be formed from a stretchable material that has isotropic properties where the material may have similar elastic properties in both longitudinal and transverse directions. In other example structures, the straps 120, 150 may be formed from a stretchable material with anisotropic properties, where the material may have different elastic properties in both longitudinal and transverse directions. In different example structures, the plurality of straps 120, 150 may be made of any suitable material that provides sufficient support while still allowing some stretchability, including, but not limited to: polymers, rubbers, plastics, elastomeric materials, and other materials. Further, the primary strap 120 may be formed of different materials, such that the first portion of the primary strap 120 is formed of a different material than the second portion of the primary strap 120. Alternatively, the straps 120, 150 may be formed from an unstretchable material.

The connection of releasable attachment regions 136, 162 and the connection of releasable attachment regions 132, 134 may each form a hook and loop type fastener (i.e. Velcro®). The use of a hook and loop type fastener on releasable attachment regions 132, 134, 136, 162 allows for a connection anywhere along the length of the releasable attachment regions 132, 134, 136, 162 to provide flexibility of adjustment locations to give the wearer multiple attachment options. Alternatively, the releasable attachment regions 132, 134, 136, 162 may include different releasable attachment methods. For instance, the releasable attachment regions 132, 134, and 136, 162 may include a plurality of discrete releasable complementary fastener components, such as snap fasteners, buttons, hooks and eyes (or rings), or other releasable fasteners known to one skilled in the art.

The apertures 117 as described herein may be an opening extending through the upper 104 where the opening may or may not be reinforced with an eyelet or other opening reinforcement structure. In some examples, the apertures 117 may be formed from a ring or other receiving member that can be attached one of sole structure 102 or the upper 104 that allows the primary strap 120 to extend through the aperture 117 and change its extension direction by turning within or against the aperture 117.

As discussed above, closure system 118 may enable the wearer to put their foot into the footwear 100 and then quickly and easily fasten the closure system 118. The closure system 118 provides a wearer multiple ways to utilize the system. One method may be for the wearer to preset the secondary strap 150 to the primary strap 120. In this method, the wearer may insert his/her foot into the footwear 100 then attach the primary strap 120 to the upper releasable attachment region 132 to find an optimal position for the primary strap 120. Then the wearer may attach the releasable attachment region 162 of the secondary strap 150 to the second releasable attachment region 136 of the primary strap 120 to find an optimal location for the secondary strap 150 on the primary strap 120. Next, the wearer may unfasten the primary strap 120 from the upper releasable attachment region 132 while keeping the secondary strap 150 attached to the primary strap 120 and remove his/her foot from the footwear 100. The wearer may keep the straps 120, 150 in this preset and engaged condition (i.e., with the secondary strap 150 engaged with the primary strap), such that when the wearer desires to wear this footwear 100, the closure system 118 can be fastened or secured by simultaneously securing the primary strap 120 and the secondary strap 150 when the first releasable attachment region 134 of the primary strap 120 is attached to the upper releasable attachment region 132. This particular preset method may be particularly useful if the wearer must quickly put the footwear on and fasten it, such as in a transition area of a triathlon. Alternatively, a wearer may insert his/her foot into the footwear 100 and attach the first releasable attachment region 134 of the primary strap 120 to the upper releasable attachment region 132 on the upper, and then attach the releasable attachment region 162 of the secondary strap 150 to the second releasable attachment region 136 of the primary strap 120.

III. CONCLUSION

The present technology disclosed above and in the accompanying drawings reference a variety of example structures. The purpose served by the disclosure, however, is to provide an example of the various features and concepts related to the technology, not to limit the scope of the disclosure. One skilled in the relevant art will recognize that numerous variations and modifications may be made to the examples described above without departing from the scope of the present invention, as defined by the appended claims.

What is claimed is:

1. An article of footwear comprising:

a sole structure;

an upper connected to the sole structure, wherein the upper includes a first side, a second side opposite the first side, an instep opening located between and partially separating the first side from the second side, and a first part of a first releasable fastener component located on the first side of the upper; and a closure system including:

a primary strap having a first fixed end, a first free end, a primary strap member extending between the first fixed end and the first free end, a second part of the first releasable fastener component, and a first part of a second releasable fastener component, wherein the first fixed end is attached to at least one of the sole structure or the upper at the first side of the upper, wherein the primary strap member extends continuously: (a) from the first fixed end, (b) across the instep opening, (c) through a first aperture defined through the second side of the upper proximate to the instep opening, and (d) across the instep opening, and wherein the second part of the first releasable fastener component releasably engages the first part of the first releasable fastener component so that the first free end of the primary strap is releasably attached to the first side of the upper rearward of a location where the first fixed end is attached to at least one of the sole structure or the upper; and a secondary strap having a second fixed end, a second free end, a secondary strap member extending between the second fixed end and the second free end, and a second part of the second releasable fastener component, wherein the second fixed end is attached to at least one of the sole structure or the upper at the second side of the upper and rearward of the first aperture, and wherein the second part of the second releasable fastener component releasably engages the first part of the second releasable fastener component so that the second free end of the secondary strap is releasably attached to the primary strap at a position on the primary strap located closer to the first free end than to the first fixed end.

2. The article of footwear of claim 1, wherein the primary strap includes a first side and a second side opposite the first side, wherein the first side of the primary strap includes the second part of the first releasable fastener component and the second side of the primary strap a includes the first part of the second releasable fastener component.

3. The article of footwear of claim 2, wherein the first releasable fastener component comprises a hook-and-loop fastener component.

4. The article of footwear of claim 2, wherein the second releasable fastener component comprises a hook-and-loop fastener component.

5. The article of footwear of claim 4, wherein the second releasable fastener component is configured so that the second free end of the secondary strap is capable of being releasably fixed to the primary strap at multiple locations along a length of the primary strap.

6. The article of footwear of claim 1, wherein the primary strap member includes a portion having a plurality of primary strap sub-members, wherein each of the primary strap sub-members attaches to at least one of the sole structure or the upper at the first side of the upper to form the first fixed end of the primary strap.

7. The article of footwear of claim 6, wherein a second aperture is defined on the second side of the upper proximate to the first aperture, wherein the first aperture receives one of the plurality of primary strap sub-members and the second aperture receives another of the plurality of primary strap sub-members.

8. The article of footwear of claim 1, further comprising a grip member having two fixed ends attached to the primary strap proximate the first free end and an elongated member extending between the two fixed ends forming an opening between the elongated member and the primary strap.

9. The article of footwear of claim 1, wherein the first side is a medial side of the article of footwear, and the second side is a lateral side of the article of footwear.

10. The article of footwear of claim 1, wherein the first side is a lateral side of the article of footwear, and the second side is a medial side of the article of footwear.

11. An article of footwear comprising:

a sole structure;

an upper connected to the sole structure, wherein the upper includes a first side, a second side opposite the first side, and a first part of a first releasable fastener component located on the first side of the upper; and a closure system including:

a primary strap having a first end, a second end, and a primary strap member extending between the first end and the second end, the primary strap member including a first portion that includes a second part of the first releasable fastener component and a first part of a second releasable fastener component arranged on opposite surfaces of the primary strap member, wherein the first portion of the primary strap member is located at a position on the primary strap closer to the first end than to the second end, the primary strap member further including a second portion, wherein the second portion comprises a plurality of primary strap sub-members, wherein the plurality of primary strap sub-members extend to the second end and are fixed to a lateral side of the article of footwear, wherein the second part of the first releasable fastener component releasably engages the first part of the first releasable fastener component to releasably secured the first portion of the primary strap member on the lateral side of the article of footwear, and a secondary strap having a fixed end on a medial side of the article of footwear, a free end, a secondary strap member extending between the fixed end and the free end, and a second part of the second releasable fastener component, wherein the second part of the second releasable fastener component releasably attaches to the first part of the second releasable fastener component of the primary strap.

12. The article of footwear of claim 11, wherein the second releasable fastener component is configured such that the secondary strap is capable of being releasably attached to the primary strap at multiple locations along a length of the primary strap.

13. The article of footwear of claim 11, wherein a width of each primary strap sub-member is less than a width of the first portion of the primary strap member.

14. The article of footwear of claim 11, wherein the second releasable fastener component comprises a hook and loop fastener.

15. The article of footwear of claim 11, further comprising a grip member having two fixed ends attached proximate to the first end of the primary strap and an elongated member extending between the fixed ends of the grip member forming an opening between the elongated member and the primary strap.

16. The article of footwear of claim 11, wherein the plurality of primary strap sub-members extend through a plurality of apertures located on the medial side of the article of footwear such that each aperture of the plurality of apertures receives one of the plurality of primary strap sub-members.

17. The article of footwear of claim 11, wherein the plurality of primary strap sub-members comprises a first strap sub-member and a second strap sub-member, wherein the first strap sub-member and the second strap sub-member are generally parallel to each other.

18. The article of footwear of claim 11, wherein the secondary strap is releasably attached to the primary strap using the second releasable fastener component prior to a wearer inserting a foot into the article of footwear such that the article of footwear is configured to be secured to the foot by simultaneously securing the primary strap and the secondary strap to the foot when the second part of the first releasable fastener component of the primary strap is attached to the first part of the first releasable fastener component of the upper.

19. An article of footwear comprising:

a sole structure;

an upper connected to the sole structure, wherein the upper includes an instep opening and a first part of a first releasable fastener component located on a lateral side of the upper; and a closure system including:

(i) a primary strap comprising:

a first portion including:

a second part of the first releasable fastener component located proximate a free end of the primary strap, and a first part of a second releasable fastener component arranged on an opposite side of the primary strap from the second part of the first releasable fastener component, the first part of the second releasable fastener component located proximate the free end of the primary strap, a second portion including:

a plurality of primary strap sub-members, wherein each primary strap sub-member of the plurality of primary strap sub-members has a fixed end attached on the lateral side of the upper proximate the instep opening, and a second end attaching to the first portion of the primary strap, and wherein each primary strap sub-member extends: (a) from its fixed end, (b) across a centerline of the upper, and (c) through an aperture on a medial side of the upper proximate the instep opening, and a grip member provided at the free end of the primary strap, wherein the grip member includes an opening defined within the grip member or between the grip member and the free end of the primary strap; and (ii) a secondary strap having a fixed end on the medial side of the article of footwear, a free end, and a second part of the second releasable fastener component located proximate the free end of the secondary strap; and wherein the second part of the first releasable fastener component is configured to be releasably engagable with the first part of the first releasable fastener component at multiple locations along a length of the first part of the first releasable fastener component, and wherein the second part of the second releasable fastener component is configured to be releasably engagable with the first part of the second releasable fastener component at multiple locations along a length of the first part of the second releasable fastener component.

20. The article of footwear of claim 19, wherein the secondary strap is releasably attached to the primary strap using the second releasable fastener component prior to a wearer inserting a foot into the article of footwear such that the article of footwear is configured to be secured to the foot by simultaneously securing the primary strap and the secondary strap to the foot when the second part of the first releasable fastener component of the primary strap is attached to the first part of the first releasable fastener component of the upper.

* * * * *